US008505215B2

(12) United States Patent
Bruce et al.

(10) Patent No.: US 8,505,215 B2
(45) **Date of Patent: *Aug. 13, 2013**

(54) ARTICLE OF FOOTWEAR FOR INCREASING STABILITY AND LATERAL PERFORMANCE

(75) Inventors: Robert M. Bruce, Portland, OR (US); Aaron A. C. Cooper, Portland, OR (US); Bo Lupo, Portland, OR (US); Kurt J. Stockbridge, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 30 days.

This patent is subject to a terminal disclaimer.

(21) Appl. No.: 13/268,067

(22) Filed: Oct. 7, 2011

(65) Prior Publication Data

US 2012/0023787 A1 Feb. 2, 2012

Related U.S. Application Data

(63) Continuation of application No. 12/129,199, filed on May 29, 2008, now Pat. No. 8,061,059.

(51) Int. Cl.
*A43B 13/00* (2006.01)

(52) U.S. Cl.
USPC ..... 36/25 R; 36/114; 36/88; 36/31

(58) Field of Classification Search
USPC ..... 36/25 R, 114, 31, 32 R, 88, 91, 92
See application file for complete search history.

(56) References Cited

U.S. PATENT DOCUMENTS

| | | | | |
|---|---|---|---|---|
| 3,308,560 | A | 3/1967 | Jones | |
| 4,030,213 | A | 6/1977 | Daswick | |
| 4,161,829 | A | 7/1979 | Wayser | |
| 4,366,634 | A | 1/1983 | Giese et al. | |
| RE31,173 | E | 3/1983 | Daswick | |
| 4,455,767 | A | 6/1984 | Bergmans | |
| 4,559,723 | A | 12/1985 | Hamy et al. | |
| 4,748,753 | A | 6/1988 | Ju | |
| 6,578,290 | B1 | 6/2003 | Meynard | |
| 6,634,121 | B2 | 10/2003 | Sordi | |
| 6,748,674 | B2 | 6/2004 | Ellis, III | |
| 7,093,379 | B2 | 8/2006 | Ellis, III | |
| 7,287,341 | B2 | 10/2007 | Ellis, III | |
| 7,290,357 | B2 | 11/2007 | McDonald et al. | |
| 8,061,059 | B2 * | 11/2011 | Bruce et al. | 36/25 R |
| 2002/0116841 | A1 | 8/2002 | Ellis, III | |
| 2006/0032086 | A1 | 2/2006 | Ellis, III | |
| 2008/0022553 | A1 | 1/2008 | McDonald et al. | |
| 2008/0229617 | A1 | 9/2008 | Johnson et al. | |
| 2009/0293308 | A1 | 12/2009 | Bruce et al. | |

FOREIGN PATENT DOCUMENTS

| | | |
|---|---|---|
| CN | 101188955 | 5/2008 |
| EP | 1114591 A2 | 7/2001 |

OTHER PUBLICATIONS

International Search Report and Written Opinion mailed Feb. 21, 2012 in International Application No. PCT/US2009/044648.
International Preliminary Report on Patentability (including Written Opinion of the ISA) mailed Mar. 8, 2012 in International Application No. PCT/US2009/044648.
Chinese Office Action issued May 17, 2013 in Chinese Patent Application No. 200980129664.5 and English translation thereof.

* cited by examiner

*Primary Examiner* — Marie Patterson
(74) *Attorney, Agent, or Firm* — Plumsea Law Group, LLC

(57) ABSTRACT

An article of footwear with multiple cross sectional profile shapes disposed on an outer peripheral edge of a sole is disclosed. The multiple cross sectional profile shapes on the outer peripheral edge of the sole can help increase the lateral performance and lateral stability of a wearer of the article of footwear.

20 Claims, 4 Drawing Sheets

ARTICLE OF FOOTWEAR FOR INCREASING STABILITY AND LATERAL PERFORMANCE

This application is a continuation of U.S. Patent Publication Number US2009/0293308 A1, published Dec. 3, 2009 (U.S. application Ser. No. 12/129,199, filed May 29, 2008), which is herein incorporated by reference in its entirety.

BACKGROUND OF THE INVENTION

1. Field of the Invention

The present invention relates to an article of footwear, and in particular to an outer peripheral edge of a sole.

2. Description of Related Art

Articles of footwear with beveled edge shapes have been proposed. Wayser (U.S. Pat. No. 4,161,829) teaches shoes intended for playing golf. Wayser teaches a sole of a left shoe that includes a curved bevel. The curved bevel allows the left shoe to pivot outwardly. Wayser also teaches a sole of a right shoe including a curved bevel that allows the translation of the right foot when the legs bend slightly to be adapted to the movement of the body when the club strikes the ball.

Ellis (U.S. Pat. No. 7,287,341) teaches corrective shoe sole structures using a contour greater than the theoretical ideal stability plane. Ellis teaches a sole that is shaped to provide natural stability for a foot.

Neither Wayser nor Ellis teaches provisions for increasing both lateral agility and lateral stability. There is a need in the art for an article that provides enhancement of both lateral agility and lateral stability.

SUMMARY OF THE INVENTION

The invention discloses an article of footwear with multiple cross sectional profile shapes disposed on an outer peripheral edge of a sole. In one aspect, the invention provides an article of footwear, comprising: a sole including an outer peripheral edge; a forefoot portion of the outer peripheral edge having a first cross sectional profile shape; an arch portion of the outer peripheral edge having a second cross sectional profile shape; a heel portion of the outer peripheral edge having a third cross sectional profile shape; and where the first cross sectional profile shape, the second cross sectional profile shape and the third cross sectional profile shape are different from one another.

In another aspect, the forefoot portion has a substantially convex cross sectional profile shape.

In another aspect, the arch portion has a substantially flat cross sectional profile shape.

In another aspect, the heel portion includes a lower portion and an upper portion.

In another aspect, the lower portion has a substantially convex cross sectional profile shape and wherein the upper portion has a substantially concave cross sectional profile shape.

In another aspect, the heel portion includes a feathered edge that separates the lower portion from the upper portion.

In another aspect, the invention provides an article of footwear, comprising: a sole including an outer peripheral edge; a lower surface of the sole configured to contact a ground surface; the outer peripheral edge comprising a first portion that is substantially curved; and where the outer peripheral edge further comprises a second portion that is generally perpendicular with the lower surface.

In another aspect, the first portion is a forefoot portion having a substantially convex cross sectional profile shape.

In another aspect, the second portion is an arch portion having a substantially flat cross sectional profile shape.

In another aspect, the first portion is a heel portion having a cross sectional profile shape with a feathered edge.

In another aspect, the substantially convex cross sectional profile shape of the forefoot portion provides lateral agility to the article of footwear.

In another aspect, the substantially flat cross sectional profile shape of the arch portion provides lateral stability to the article of footwear.

In another aspect, the outer peripheral edge includes an intermediate portion disposed between the first portion and the second portion and wherein the intermediate portion has a cross sectional profile shape between a convex shape and a substantially flat shape.

In another aspect, the invention provides an article of footwear, comprising: a sole including an outer peripheral edge; a first portion of the outer peripheral edge having a first cross sectional profile shape that is configured to provide traction when an article is titled onto the outer peripheral edge; and a second portion of the outer peripheral edge having a second cross sectional profile shape that is configured for lateral stability.

In another aspect, the first cross sectional profile shape is a substantially convex shape.

In another aspect, the second cross sectional profile shape is a substantially flat shape that is oriented in a generally vertical direction between an upper surface of the sole and a lower surface of the sole.

In another aspect, the sole includes a heel rise in the range between 2 to 8 millimeters.

In another aspect, the heel rise is approximately 4 millimeters.

In another aspect, the first portion is disposed on a forefoot portion of the outer peripheral edge.

In another aspect, the second portion is disposed on an arch portion of the outer peripheral edge.

Other systems, methods, features, and advantages of the invention will be, or will become apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
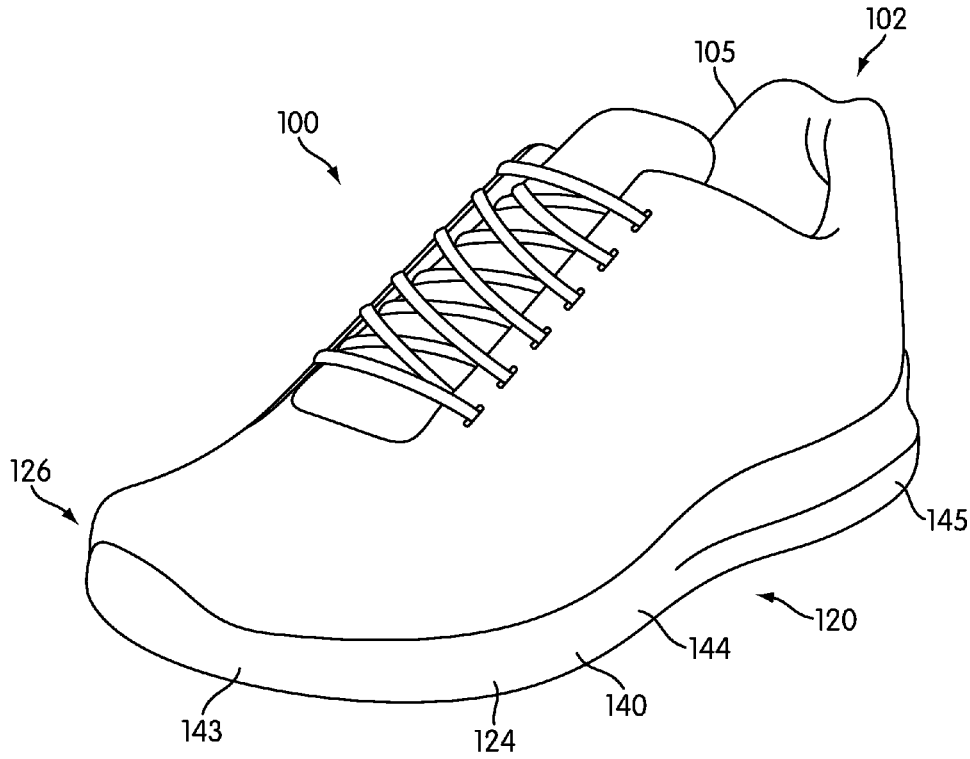
FIG. 1 is an isometric view of a preferred embodiment of an article of footwear.
Figure 2:
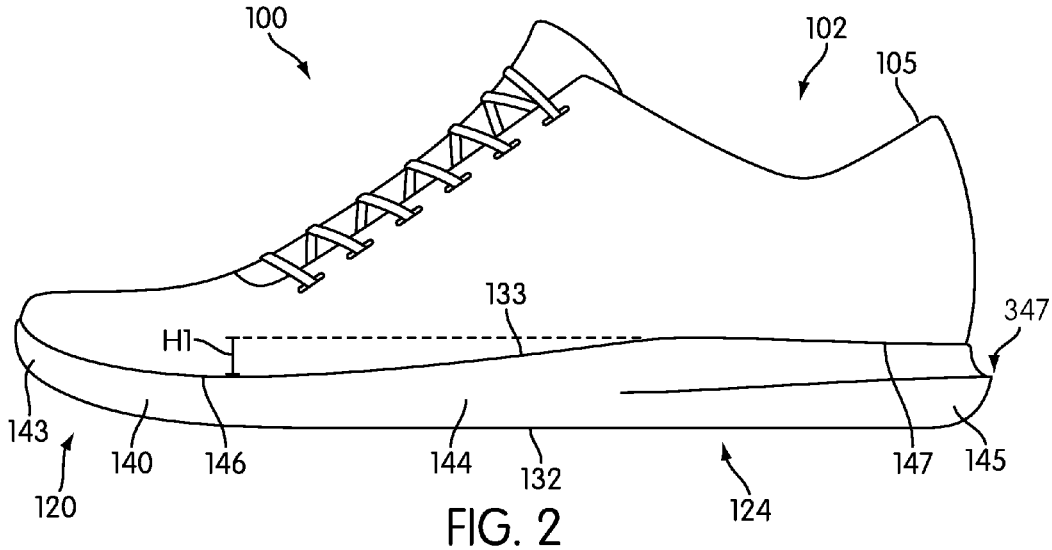
FIG. 2 is a side view of a preferred embodiment of an article of footwear.

FIGS. 1-2 illustrate a preferred embodiment of article of footwear 100. In particular, FIG. 1 is an isometric view of a preferred embodiment of article of footwear 100 and FIG. 2 is a side view of a preferred embodiment of article of footwear 100. For clarity, the following detailed description discusses a preferred embodiment, in the form of a sneaker, but it should be noted that the present invention could take the form of any article of footwear including, but not limited to hiking boots, soccer shoes, football shoes, rugby shoes, baseball shoes, as well as other kinds of shoes. As shown in FIG. 1, article of footwear 100, also referred to simply as article 100, is intended to be used with a right foot; however, it should be understood that the following discussion may equally apply to a mirror image of article of footwear 100 that is intended for use with a left foot.

Article of footwear 100 preferably includes upper 102. Generally, upper 102 may be any type of upper. In particular, upper 102 could have any design, shape, size, and/or color. Preferably, upper 102 is configured to receive the foot of a wearer. In this embodiment, upper 102 may include entry hole 105 for receiving a foot.

Upper 102 may be associated with sole 120. Preferably, sole 120 is configured with a shape that generally conforms to a lower surface of a foot. Referring to FIG. 2, sole 120 includes upper surface 133 that may be disposed adjacent to upper 102. During use, upper surface 133 may contact, or be disposed adjacent to, a foot. Similarly, sole 120 includes lower surface 132. Lower surface 132 is preferably configured to contact a ground surface.

In different embodiments, sole 120 may include one or more components. In some embodiments, sole 120 may include a midsole. In other embodiments, sole 120 may include an outsole. In still other embodiments, sole 120 may include an insole that is configured to be disposed within upper 102. For purposes of clarity, sole 120 is illustrated in the Figures as a midsole without an outsole or an insole.

In some embodiments, sole 120 may include provisions for traction. In some cases, sole 120 may include traction elements. In other cases, sole 120 may include cleats. In still other cases, sole 120 may include a combination of cleats and tread elements. For purposes of clarity, no cleats or traction elements are shown in the Figures.

Typically, a sole may be configured with a heel rise. The term "heel rise" as used throughout this detailed description and in the claims refers to a difference in heights between the portion of a sole adjacent to a heel and the portion of a sole adjacent to a forefoot. For example, a high heeled shoe may be configured with a large heel rise. Likewise, a sandal may be configured with a low heel rise. In different embodiments, the amount of heel rise of the sole may affect stability.

In articles intended for use in athletic activities, a sole may include provisions for increasing stability by reducing the amount a heel rises with respect to a forefoot. Referring to FIG. 2, upper surface 133 of sole 120 may include forefoot upper surface 146 that may be configured to contact the forefoot of a wearer of article 100. Similarly, upper surface 133 of sole 120 may include heel upper surface 147 that may be associated with a heel of the wearer of article 100.

Generally, forefoot upper surface 146 and heel upper surface 147 may be configured with any height with respect to a ground surface. In some embodiments, forefoot upper surface 146 and heel upper surface 147 may be configured with substantially similar heights. In other embodiments, forefoot upper surface 146 and heel upper surface 147 may be configured with different heights. In a preferred embodiment, heel upper surface 147 has a greater height than forefoot upper surface 146. In other words, sole 120 may be configured with a heel rise.

In the current embodiment, sole 120 includes a heel rise H1, which is the difference in height between forefoot upper surface 146 and heel upper surface 147. In different embodiments, the value of H1 can vary. In some embodiments, the value of heel rise H1 can be in the range between 8-12 millimeters. In other embodiments, the value of heel rise H1 can be in the range between 2-8 millimeters. In still other embodiments, the value of heel rise H1 can be 12 or more millimeters. In a preferred embodiment, sole 120 includes a shallow heel rise of approximately 4 millimeters. In other words, in a preferred embodiment, heel upper surface 147 is approximately 4 millimeters higher than forefoot upper surface 146. Using this configuration, sole 120 may provide a wearer with increased stability.

Preferably, a sole is configured with an outer peripheral edge. The term "outer peripheral edge" as used throughout this detailed description and in the claims refers to an outer portion of a sole that extends from a lower surface of a sole to an upper of an article. Typically, an outer peripheral edge is angled with respect to a lower surface of a sole. In some cases, an outer peripheral edge of a sole may be visible on an exterior of an article.

In a preferred embodiment, sole 120 is configured with outer peripheral edge 140. Outer peripheral edge 140 extends between upper 102 and lower surface 132. Furthermore, outer peripheral edge 140 circumscribes sole 120. In other words, referring to FIG. 1, outer peripheral edge 140 is disposed on both medial portion 124 of sole 120 and lateral portion 126 of sole 120.

Outer peripheral edge 140 may comprise multiple portions. In this embodiment, outer peripheral edge 140 includes forefoot portion 143. In addition, outer peripheral edge 140 includes heel portion 145. Furthermore, outer peripheral edge 140 includes arch portion 144 that is disposed between forefoot portion 143 and heel portion 145.

An outer peripheral edge may be associated with a cross sectional profile shape. The term "cross sectional profile shape" as used throughout this detailed description and in the claims refers to a cross sectional shape of an outer peripheral edge as the outer peripheral edge extends between an upper and a lower surface of a sole. In other words, the cross sectional profile shape is the shape of the outer peripheral edge as viewed in cross section.

Generally, an outer peripheral edge can be configured with any cross sectional profile shape. In some embodiments, the outer peripheral edge can have a substantially flat cross sectional profile shape. In some cases, the outer peripheral edge can have a flat cross sectional profile shape that extends in a generally perpendicular direction to a lower surface of a sole. In other cases, the outer peripheral edge can have a flat cross sectional profile shape that extends at another angle to the lower surface of the sole. In other embodiments, the outer peripheral edge can be configured with a curved cross sectional profile shape. In some cases, the outer peripheral edge can have a convex cross sectional profile shape. In other cases, the outer peripheral edge can have a concave cross sectional profile shape. In a preferred embodiment, the outer peripheral edge can include multiple different cross sectional profile shapes. For example, in some embodiments, the outer peripheral edge can include a first portion with a substantially curved cross sectional profile shape and a second portion with a substantially flat cross sectional profile shape.

Figure 3:
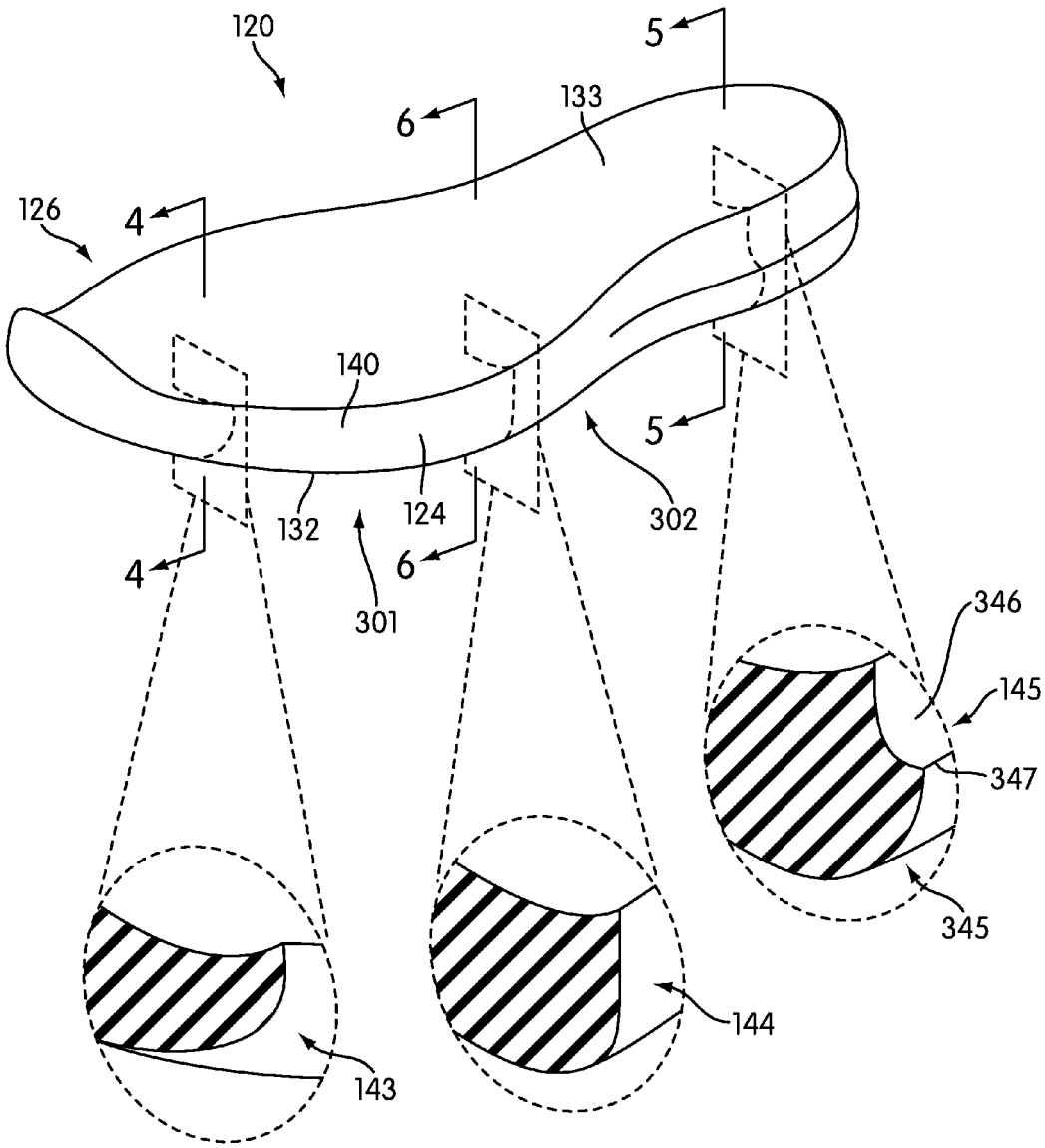
FIG. 3 is an isometric view of a preferred embodiment of a sole with enlarged views of cross sectional profile shapes of an outer peripheral edge.

FIG. 3 is an isometric view of a preferred embodiment of sole 120. For purposes of clarity, sole 120 is illustrated without upper 102. This allows upper surface 133 of sole 120 to be visible. FIG. 3 also includes enlarged views of cross sectional profile shapes associated with different portions of outer peripheral edge 140. Although only medial portion 124 of sole 120 is visible, it should be understood that the following discussion of cross sectional profile shapes on outer peripheral edge 140 applies equally to lateral portion 126. In other embodiments, however, medial portion 124 of outer peripheral edge 140 may be configured with different profiles shapes than lateral portion 126.

An outer peripheral edge can include provisions for increasing lateral performance on a forefoot portion of the edge. In some embodiments, a curved cross sectional profile shape on a portion of an outer peripheral edge can provide better lateral performance for a wearer of an article. In some cases, a forefoot can be configured with a curved cross sectional profile shape. This curved cross sectional profile shape can enhance the lateral performance of a wearer of an article as the wearer moves and contacts a ground surface with a forefoot portion of an outer peripheral edge. In particular, as the article tilts onto the outer peripheral edge during a turn or another lateral maneuver, the curved outer peripheral edge can remain in contact with the ground to provide continued traction and thus assist with lateral performance.

In this embodiment, forefoot portion 143 of outer peripheral edge 140 includes a generally convex cross sectional profile shape. With this generally convex cross sectional profile shape, forefoot portion 143 protrudes outward from sole 120 as outer peripheral edge 140 extends between lower surface 132 and upper surface 133. This preferred cross sectional profile shape allows forefoot portion 143 to enhance the lateral agility of a wearer.

During lateral maneuvers, article 100 may lean or tilt to one side, so that a portion or an entirety of lower surface 132 loses contact with a ground surface. In some cases, a portion or an entirety of lower surface 132 may lose contact with a ground surface as article 100 is tilted towards medial portion 124 or lateral portion 126 of sole 120. As a portion of lower surface 132 loses contact with a ground surface, the generally convex cross sectional profile shape of forefoot portion 143 may contact a ground surface. With this arrangement, forefoot portion 143 can remain in contact with a ground surface to enhance lateral performance for a wearer when a portion of lower surface 132 leaves a ground surface.

Figure 7:
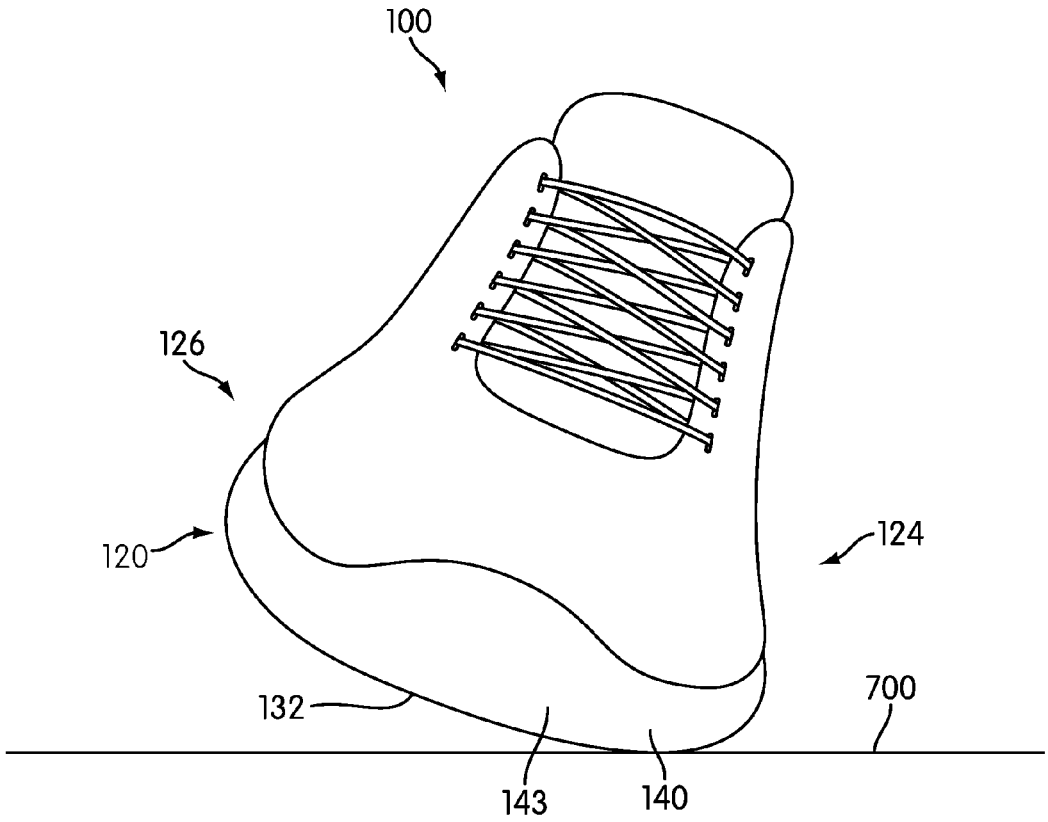
FIG. 7 is a front view of an exemplary embodiment of an article leaning on an outer peripheral edge.

Referring to FIG. 7, article 100 may tilt towards medial portion 124 as a wearer turns. In some cases, a portion of lower surface 132 may lose contact with ground surface 700. Preferably, as article 100 tilts toward medial portion 124, forefoot portion 143 of sole 120 contacts ground surface 700. In particular, forefoot portion 143 contacts ground surface 700 because of the generally convex cross sectional profile shape. By remaining in contact with ground surface 700, forefoot portion 143 maintains traction with ground surface 700 for article 100 during the turn. Using this preferred configuration of a generally convex cross sectional profile shape, forefoot portion 143 can enhance lateral performance for a wearer of article 100.

In contrast, in embodiments with a forefoot portion of an outer peripheral edge having a substantially flat cross section, the forefoot portion may not contact a ground surface when the article is titled to one side. This can cause a wearer to lose traction with the ground surface and can result in less efficient turning and/or other types of lateral movement.

An outer peripheral edge can also include provisions to increase the stability of a sole. In some embodiments, a substantially flat cross sectional profile shape that extends in a generally perpendicular direction to a lower surface of a sole can provide lateral stability for a wearer of an article. In some cases, an arch portion of an outer peripheral edge can be configured with a substantially flat cross sectional profile shape to increase lateral stability. In particular, this configuration can increase lateral stability by providing a strong base for a wearer, which may assist a wearer in balancing while standing or when the foot is fully planted.

Preferably, outer peripheral edge 140 is also configured to provide lateral stability to article 100. In this preferred embodiment, arch portion 144 includes a generally flat cross sectional profile shape, as illustrated in FIG. 3. Specifically, the generally flat cross sectional profile shape extends in a generally perpendicular direction between upper surface 133 and lower surface 132. Preferably, lower surface 132 adjacent to arch portion 144 contacts a ground surface as a wearer stands or plants article 100. This allows the generally flat profile cross sectional shape of arch portion 144 to provide a strong base for article 100. Using this configuration of a generally flat profile cross sectional shape, arch portion 144 provides lateral stability for a wearer and can help prevent rocking or titling when a wearer is standing.

In some embodiments, a portion of an outer peripheral edge can be configured with a cross sectional profile shape that comprises multiple distinct types of curvature. For example, in some embodiments, a portion of an outer peripheral edge can include an upper portion with a concave cross sectional profile shape disposed above a lower portion with a convex cross sectional profile shape. In other embodiments, the outer peripheral edge can comprise three or more portions with distinct types of curvature that are disposed adjacent to one another in a generally vertical direction. The term "vertical direction" as used throughout this detailed description and in the claims refers to a direction that extends between a lower surface and an upper surface of a sole. In other words, the vertical direction is oriented in a generally perpendicular manner to the lower surface and the upper surface of the sole.

In this preferred embodiment, heel portion 145 of outer peripheral edge 140 includes lower portion 345. Preferably, lower portion 345 is configured with a substantially convex cross sectional profile shape. In particular, lower portion 345 may protrude outwards from lower surface 132 of sole 120. Heel portion 145 also preferably includes upper portion 346 that is disposed above lower portion 345. In contrast to lower portion 345, which has a substantially convex shape, upper portion 346 is preferably configured with a substantially concave cross sectional profile shape. In particular, upper portion 346 may curve inwards from lower portion 345 to upper surface 133.

In different embodiments, the heights of upper portion 346 and lower portion 345 can vary. In some embodiments, upper portion 346 may be disposed over a majority of the height of heel portion 145. For example, in one embodiment, upper portion 346 could extend over about three fourths of the height of heel portion 145. In other embodiments, lower portion 345 may be disposed over a majority of the height of heel portion 145. In a preferred embodiment, upper portion 346 and lower portion 345 may be disposed over substantially equal portions of the height of heel portion 145. In other words, lower portion 345 may extend from lower surface 132 to about the middle of heel portion 145, while upper portion 346 may extend from upper surface 133 down to about the middle of heel portion 145.

In embodiments with cross sectional profile shapes having multiple portions with distinct types of curvature arranged in a vertical direction, an outer peripheral edge may include provisions for joining the portions in a manner that enhances lateral stability and/or lateral agility. In a preferred embodiment, lower portion 345 and upper portion 346 may be joined together at feathered edge 347. Feathered edge 347 preferably extends around heel portion 145 separating upper portion 346 from lower portion 345. Furthermore, in this embodiment, feathered edge 347 extends slightly outward from upper 102, as illustrated in FIG. 2. With this arrangement, outer peripheral edge 140 can be provided with a slightly wider base that can enhance lateral stability of sole 120.

In addition, this feathered edge arrangement for heel portion 145 can provide a greater surface area for lower portion 345 to contact a ground surface, which can enhance lateral agility at heel portion 145. In particular, lower portion 345 is preferably configured to contact a ground surface when article 100 leans or tilts to a lateral or medial side. Preferably, lower portion 345 may be able to provide continued traction for article 100 during turns or other lateral maneuvers in a manner similar to forefoot portion 143.

Outer peripheral edge 140 may include transitional portions between multiple cross sectional profile shapes in a longitudinal direction, as well as a vertical direction. The term "longitudinal direction" as used throughout this detailed description and in the claims, refers to a direction running between the forefoot and heel of an article. In this embodiment, outer peripheral edge 140 includes first intermediate portion 301. First intermediate portion 301 is disposed between forefoot portion 143 and arch portion 144. With this arrangement, first intermediate portion 301 provides a transition between the generally convex cross sectional profile shape of forefoot portion 143 and the generally flat cross sectional profile shape of arch portion 144. This can be accomplished by configuring first intermediate portion 301 with a convex curved cross sectional profile shape adjacent to forefoot portion 143 that gradually flattens to a generally flat cross sectional profile shape adjacent to arch portion 144.

In a similar manner, outer peripheral edge 140 includes second intermediate portion 302. Second intermediate portion 302 is disposed between arch portion 144 and heel portion 145. Using this configuration, second intermediate portion 302 provides a transition from the generally flat cross sectional profile shape of arch portion 144 to the feathered cross sectional profile shape of heel portion 145. In order to transition between arch portion 144 and heel portion 145, second intermediate portion 302 may include a generally flat cross sectional profile shape disposed adjacent to arch portion 144. Likewise, second intermediate portion 302 can include a feathered shape disposed adjacent to heel portion 145. With this configuration, second intermediate portion 302 can gradually increase the curvature of outer peripheral edge 140 from a generally flat cross sectional profile shape to a feathered cross sectional profile shape.

In some embodiments, the curvature of a convex cross sectional profile shape or a concave cross sectional profile shape may be associated with a radius of curvature. The term "radius of curvature" as used throughout this detailed description and in the claims refers to the radius of a circle that is generally coincident with a curved cross sectional profile shape. In some cases, a curved cross sectional profile shape may be associated with more than one radius of curvature. In other words, the curved cross sectional profile shape may not be configured with a constant curvature. Typically, a long radius of curvature indicates a more gradual curved cross sectional profile shape. Likewise, a short radius of curvature indicates a sharper curved cross sectional profile shape.

Figure 4:
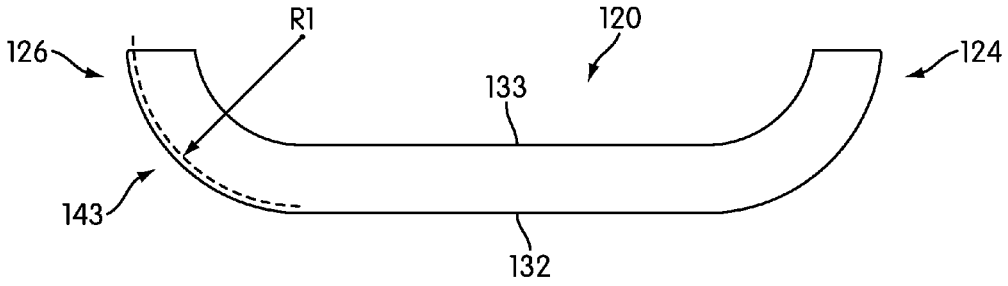
FIG. 4 is a cross sectional view of a preferred embodiment of a forefoot portion of a sole.
Figure 5:
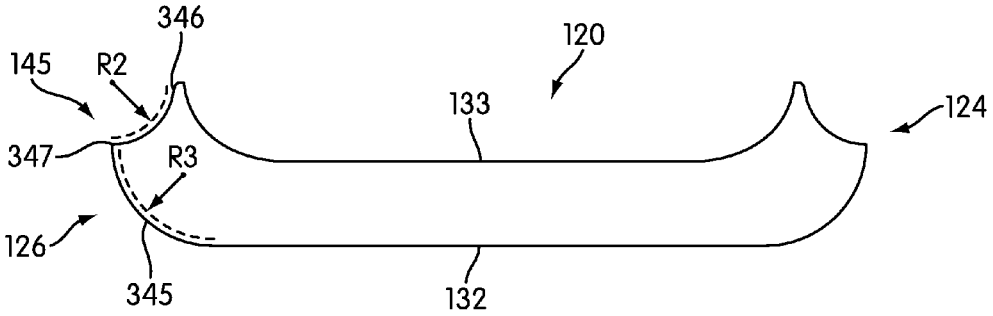
FIG. 5 is a cross sectional view of a preferred embodiment of a heel portion of a sole.
Figure 6:
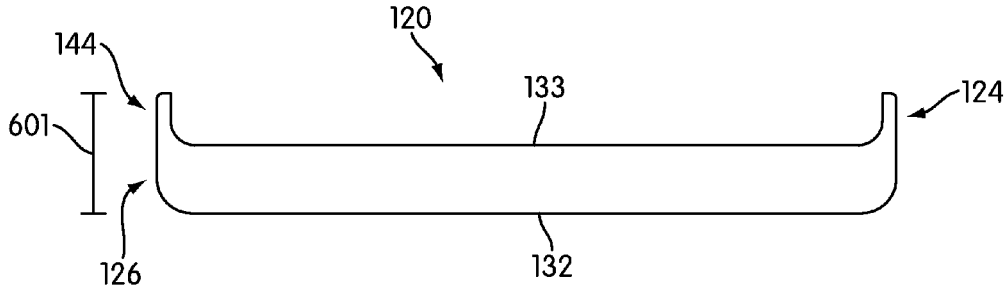
FIG. 6 is a cross sectional view of a preferred embodiment of an arch portion of a sole.

FIGS. 4-6 illustrate cross sectional views of portions of a preferred embodiment of sole 120. For purposes of clarity, this detailed description of cross sectional profile shapes of outer peripheral edge 140 may refer to cross sectional profile shapes disposed on lateral portion 126 of outer peripheral edge 140. It should be understood that this discussion may apply equally to cross sectional profile shapes disposed on medial portion 124 because in this embodiment medial portion 124 and lateral portion 126 of outer peripheral edge 140 are configured with substantially similar cross sectional profile shapes. However, in other embodiments, medial portion 124 and lateral portion 126 of outer peripheral edge 140 can include different cross sectional profile shapes. For example, in some cases, forefoot portion 143 can include a cross sectional profile shape that is convex on medial portion 124 of forefoot portion 143 and a cross sectional profile shape that is concave on lateral portion 126 of forefoot portion 143.

Referring to FIG. 4, forefoot portion 143 is configured with a generally convex cross sectional profile shape. In this embodiment, the curvature of forefoot portion 143 may be approximated with first radius of curvature R1. Although in the current embodiment the curvature of forefoot portion 143 can be approximated by a single radius of curvature, in other cases, the convex cross sectional profile shape of forefoot portion 143 may be associated with multiple radii of curvature.

In different embodiments, the value of first radius of curvature R1 can vary. In this embodiment, first radius of curvature R1 is a relatively long radius. With this arrangement, the convex cross sectional profile shape of forefoot portion 143 comprises a gradual curve as forefoot portion 143 extends from lower surface 132 to upper surface 133.

FIG. 4 is only intended to illustrate a portion of forefoot portion 143 of outer peripheral edge 140. It should be understood that the curvature at different portions of forefoot portion 143 can vary. Additionally, in some embodiments, the height of outer peripheral edge 140 can vary over the length of forefoot portion 143. For example, in some embodiments, the height of outer peripheral edge 140 can be shorter towards a toe portion of sole 120 than near arch portion 144.

Preferably, this convex cross sectional profile shape allows forefoot portion 143 to contact a ground surface when article 100, as illustrated in FIG. 7, leans onto forefoot portion 143. With this configuration, forefoot portion 143 can provide sustained traction to a wearer of article 100 during turning or other lateral movements. This allows forefoot portion 143 to enhance the lateral performance of the wearer of article 100.

As previously discussed, heel portion 145 includes upper portion 346 with a concave cross sectional profile shape that curves inward towards sole 120. Generally, upper portion 346 may be configured with any radius of curvature. In this embodiment, upper portion 346 is configured with second radius of curvature R2, as illustrated in FIG. 5. Preferably, second radius of curvature R2 is shorter than first radius of curvature R1. With this configuration, upper portion 346 comprises a sharper contour than the generally convex cross sectional profile shape of forefoot portion 143.

Heel portion 145 also includes lower portion 345 with a convex cross sectional profile shape that protrudes outward on sole 120. Generally, lower portion 345 can comprise one or more radii of curvature. In this embodiment, lower convex cross sectional profile shape 345 includes third radius of curvature R3. Third radius of curvature R3 is preferably shorter than second radius of curvature R2. In other embodiments, however, second radius of curvature R2 may be shorter than third radius of curvature R3. With this preferred arrangement, lower portion 345 comprises a sharper curve than upper portion 346.

As previously discussed, feathered edge 347 extends outward from sole 120. With this arrangement, feathered edge 347 joins lower portion 345 and upper portion 346. Furthermore, as feathered edge 347 extends outward, lower portion 345 and upper portion 346 are configured with longer curved cross sectional profile shapes. With this arrangement, upper portion 346, feathered edge 347 and lower portion 345 can enhance the lateral performance of a wearer by providing continued traction for sole 120 as sole 120 is tilted to a lateral or medial side. Furthermore, lower portion 345 and upper portion 346 are configured to join at feathered edge 347 in a manner that provides a slightly wider base for heel portion 145. This slightly wider base for heel portion 145 can help increase lateral stability.

Referring to FIG. 6, arch portion 144 comprises a generally flat cross sectional profile shape. For illustrative purposes, FIG. 6 includes vertical indicator 601. Vertical indicator 601 extends in a generally perpendicular direction to lower surface 132. Preferably, the flat cross sectional profile shape of arch portion 144 is substantially parallel with vertical indicator 601. In other words, arch portion 144 extends in a generally perpendicular direction to lower surface 132. By extending in a generally perpendicular direction to lower surface 132, arch portion 144 may be prevented from rocking or tilting to a lateral or medial side, which can facilitate lateral stability for a wearer of article 100.

Although the preferred embodiment comprises cross sectional profile shapes that are generally spherically curved or flat, it should be understood that in other embodiments, a portion of an outer peripheral edge can have any other type of cross sectional profile shape. Examples of shapes that may be associated with a portion of an outer peripheral edge include, but are not limited to, triangular shapes, elliptical shapes, rectangular shapes, pentagon shapes, hexagon shapes, regular polygonal shapes, irregular shapes, as well as any other types of shapes.

Preferably, the use of multiple cross sectional profile shapes in an outer peripheral edge of a sole provides lateral stability and enhances lateral performance of a wearer of an article of footwear. In particular, in some cases, curved cross sectional profile shapes disposed on a forefoot portion and a heel portion of an outer peripheral edge can provide lateral agility to a wearer of an article, since the wearer may make turns on the forefoot portion. Additionally, generally flat cross sectional profile shapes disposed on an arch portion can provide lateral stability to the wearer of an article, since the arch portion is typically in contact with a ground surface while standing or when a foot is fully planted.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole including an outer peripheral edge;

a forefoot portion of the outer peripheral edge having a first cross sectional profile shape;

an arch portion of the outer peripheral edge having a second cross sectional profile shape; and a heel portion of the outer peripheral edge having a third cross sectional profile shape on at least one of a lateral side and a medial side of the heel portion, wherein the first cross sectional profile shape, the second cross sectional profile shape, and the third cross sectional profile shape are different from one another, wherein the third cross sectional profile shape of the heel portion includes a lower portion and an upper portion, wherein the lower portion has a substantially convex cross sectional profile shape, wherein the upper portion has a substantially concave cross sectional profile shape, wherein the third cross sectional profile shape of the heel portion includes a transition edge at which the substantially convex cross sectional profile shape of the lower portion transitions to the substantially concave cross sectional profile shape of the upper portion, wherein the substantially convex cross sectional profile shape of the lower portion of the first cross sectional profile shape gradually decreases in radius of curvature moving in a direction from the arch portion to the heel portion, wherein the substantially concave cross sectional profile shape of the upper portion of the first cross sectional profile shape gradually decreases in radius of curvature moving in the direction from the arch portion to the heel portion, and wherein the transition edge extends increasingly laterally outward from the sole moving in the direction from the arch portion to the heel portion.

2. The article of footwear according to claim 1, wherein a lateral side of the forefoot portion has a substantially convex cross sectional profile shape.

3. The article of footwear according to claim 1, wherein a medial side of the arch portion has a substantially flat cross sectional profile shape.

4. The article of footwear according to claim 1, wherein the sole includes a heel rise in the range between 2 to 8 millimeters.

5. The article of footwear according to claim 1, wherein the transition edge extends around the lateral side, a rear side, and the medial side of the heel portion.

6. The article of footwear according to claim 1, wherein the second cross sectional profile shape of the arch portion is a substantially flat cross sectional profile shape, wherein the outer peripheral edge includes an intermediate portion disposed between the heel portion and the arch portion, wherein the intermediate portion transitions from the substantially flat cross sectional profile shape of the arch portion to the substantially convex cross sectional profile shape of the lower portion of the third cross sectional profile shape of the heel portion and the substantially concave cross sectional profile shape of the upper portion of the third cross sectional profile shape of the heel portion.

7. An article of footwear, comprising:

a sole including an outer peripheral edge;

a forefoot portion of the outer peripheral edge having a first cross sectional profile shape;

an arch portion of the outer peripheral edge having a second cross sectional profile shape; and a heel portion of the outer peripheral edge having a third cross sectional profile shape on at least one of a lateral side and a medial side of the heel portion, wherein the first cross sectional profile shape, the second cross sectional profile shape, and the third cross sectional profile shape are different from one another, wherein the third cross sectional profile shape of the heel portion includes a lower portion and an upper portion, wherein the lower portion has a substantially convex cross sectional profile shape, wherein the upper portion has a substantially concave cross sectional profile shape, and wherein the heel portion includes the lower portion and the upper portion continuously around the lateral side, a rear side, and the medial side of the heel portion.

8. An article of footwear, comprising:

a sole including an outer peripheral edge;

a forefoot portion of the outer peripheral edge having a first cross sectional profile shape;

an arch portion of the outer peripheral edge having a second cross sectional profile shape; and a heel portion of the outer peripheral edge having a third cross sectional profile shape on at least one of a lateral side and a medial side of the heel portion, wherein the first cross sectional profile shape, the second cross sectional profile shape, and the third cross sectional profile shape are different from one another, wherein the third cross sectional profile shape of the heel portion includes a lower portion and an upper portion, wherein the lower portion has a substantially convex cross sectional profile shape, wherein the upper portion has a substantially concave cross sectional profile shape, wherein the third cross sectional profile shape of the heel portion includes a transition edge at which the substantially convex cross sectional profile shape of the lower portion transitions to the substantially concave cross sectional profile shape of the upper portion, and wherein the transition edge extends around the lateral side, a rear side, and the medial side of the heel portion.

9. An article of footwear, comprising:

a sole including an outer peripheral edge; and a lower surface of the sole configured to contact a ground surface, wherein the outer peripheral edge comprises a forefoot portion, an arch portion, and a heel portion, wherein the heel portion comprises a lower portion having a substantially convex cross sectional profile shape, an upper portion having a substantially concave cross sectional profile shape, and a transition edge at which the substantially convex cross sectional profile shape of the lower portion transitions to the substantially concave cross sectional profile shape of the upper portion, and wherein the transition edge extends around a lateral side, a rear side, and a medial side of the heel portion.

10. The article of footwear according to claim 9, wherein the arch portion of the outer peripheral edge extends for a length from the forefoot portion to the heel portion in a longitudinal direction of the sole, and wherein a lateral side of the arch portion is substantially perpendicular to the lower surface substantially throughout the length of the arch portion.

11. The article of footwear according to claim 9, wherein the forefoot portion of the outer peripheral edge has a substantially convex cross sectional profile shape.

12. The article of footwear according to claim 9, wherein a medial side of the arch portion has a substantially flat cross sectional profile shape.

13. The article of footwear according to claim 9, wherein the arch portion of the outer peripheral edge has a first length on a lateral side of the outer peripheral edge and a second length on a medial side of the outer peripheral edge, and wherein the first length differs from the second length such that a cross sectional profile shape of the sole cut through a plane that is substantially perpendicular to a longitudinal axis of the sole is asymmetrical.

14. An article of footwear, comprising:

a sole including an outer peripheral edge, wherein the outer peripheral edge comprises a forefoot portion, an arch portion, and a heel portion, wherein the heel portion of the outer peripheral edge has a cross sectional profile shape that extends around a lateral side, a rear side, and a medial side of the heel portion, wherein the cross sectional profile shape includes a lower portion and an upper portion, wherein the lower portion has a substantially convex cross sectional profile shape, and wherein the upper portion has a substantially concave cross sectional profile shape.

15. The article of footwear according to claim 14, wherein the cross sectional profile shape further comprises a transition edge at which the substantially convex cross sectional profile shape of the lower portion transitions to the substantially concave cross sectional profile shape of the upper portion, and wherein the transition edge extends increasingly laterally outward from the sole moving in a direction from the arch portion to the heel portion.

16. The article of footwear according to claim 14, wherein the forefoot portion has a cross sectional profile shape that is a substantially convex shape.

17. The article of footwear according to claim 14, wherein a lateral side of the forefoot portion of the outer peripheral edge is substantially convex, and wherein a lateral side of the arch portion of the outer peripheral edge is substantially flat and perpendicular to a ground-contacting surface of the sole.

18. The article of footwear according to claim 14, wherein the sole includes a heel rise in the range between 2 to 8 millimeters.

19. The article of footwear according to claim 18, wherein the heel rise is approximately 4 millimeters.

20. The article of footwear according to claim 14, wherein the substantially convex cross sectional profile shape of the lower portion of the cross sectional profile shape gradually decreases in radius of curvature moving in a direction from the arch portion to the heel portion, and wherein the substantially concave cross sectional profile shape of the upper portion of the cross sectional profile shape gradually decreases in radius of curvature moving in the direction from the arch portion to the heel portion.

* * * * *